US009103081B1

(12) United States Patent
Mangin

(10) Patent No.: US 9,103,081 B1
(45) Date of Patent: Aug. 11, 2015

(54) BELOW MAIN CABLE WORK PLATFORM SUPPORT

(71) Applicant: TDA Construction, Inc., Tarrytown, NY (US)

(72) Inventor: Brian Mangin, Franklin Lakes, NJ (US)

(73) Assignee: Platform Easy, L.L.C., Yonkers, NY (US)

( * ) Notice: Subject to any disclaimer, the term of this patent is extended or adjusted under 35 U.S.C. 154(b) by 4 days.

(21) Appl. No.: 14/188,942

(22) Filed: Feb. 25, 2014

Related U.S. Application Data

(60) Provisional application No. 61/869,207, filed on Aug. 23, 2013.

(51) Int. Cl.
*E01D 19/10* (2006.01)
*E01D 22/00* (2006.01)
*E04G 3/22* (2006.01)

(52) U.S. Cl.
CPC ..... *E01D 22/00* (2013.01); *E01D 19/10* (2013.01); *E04G 3/22* (2013.01)

(58) Field of Classification Search
CPC ..... E04G 3/22; E01D 19/10; E01D 19/106
See application file for complete search history.

(56) References Cited

U.S. PATENT DOCUMENTS

| | | | | |
|---|---|---|---|---|
| 4,615,063 | A | 10/1986 | Rolen | |
| 4,660,680 | A | 4/1987 | Potin | |
| 5,048,640 | A | 9/1991 | McConville et al. | |
| 5,299,655 | A | 4/1994 | Margaritis | |
| 5,678,654 | A * | 10/1997 | Uzawa | 182/150 |
| 5,911,288 | A * | 6/1999 | Zafirakis | 182/150 |
| 6,138,793 | A | 10/2000 | Apostolopoulos | |
| 6,302,237 | B1 | 10/2001 | Apostolopoulos | |
| 6,302,238 | B1 | 10/2001 | Preusser et al. | |
| 6,523,644 | B2 | 2/2003 | Apostolopoulos | |
| 6,817,444 | B1 | 11/2004 | Shinas | |
| 7,552,685 | B2 | 6/2009 | Frangos et al. | |
| 2001/0037914 | A1 | 11/2001 | Preusser et al. | |
| 2004/0020138 | A1 | 2/2004 | Grearson | |
| 2014/0251730 | A1 * | 9/2014 | Bisset | 182/150 |
| 2014/0345976 | A1 * | 11/2014 | Grumberg et al. | 182/223 |

FOREIGN PATENT DOCUMENTS

| | | |
|---|---|---|
| WO | WO9705348 | 2/1997 |
| WO | WO0216708 | 2/2002 |

* cited by examiner

*Primary Examiner* — Alvin Chin-Shue
(74) *Attorney, Agent, or Firm* — Werschulz Patent Law, LLC

(57) ABSTRACT

A below main cable work platform support for hanging a work platform below a main cable of a suspension bridge and a method of installation thereof. A plurality of supports attach to each band on a main cable. Each support has a pair of struts bolted to the band, the top of each strut on each side of the band, the struts extending downward, connecting to the ends of a horizontal bar that sits between a pair of suspender cables hanging from each band. A work platform is suspended from the horizontal bar and tie down cables extend downward from the bar attaching below to stabilize the platform against wind and uplift. The method includes the step of screwing a single bolt into each side of a cable band for supporting the support therebelow.

20 Claims, 8 Drawing Sheets

BELOW MAIN CABLE WORK PLATFORM SUPPORT

CROSS-REFERENCE TO RELATED APPLICATIONS

This application is a nonprovisional utility application of the provisional patent application, Ser. No. 61/869,207 filed in the United States Patent Office on Aug. 23, 2013 and claims the priority thereof and is expressly incorporated herein by reference in its entirety.

TECHNICAL FIELD

The present disclosure relates generally to a platform support and a method of installing said support. More particularly, the present disclosure relates to a below main cable work platform support for hanging a work platform below a main cable of a suspension bridge and a method of installation.

BACKGROUND

A suspension bridge is a type of bridge in which the load-bearing portion called the deck is hung below main suspension cables on vertical hangers or suspender cables. The main cables are suspended between towers and form a parabola, the suspenders transferring the load to the cables and the cables transferring the load to the towers.

The main cables are generally braided steel wire and are over-wrapped to form a circular cross section. At specific points along the main cable, bands are installed to carry the steel wire suspenders.

Like any steel that is constantly exposed to the elements, the steel of cables requires periodic maintenance. Generally, maintenance projects require that the bridge be shut down completely or reduced to a minimum number of lanes. Since most bridges carry a significant amount of traffic during most of the day and night, maintenance usually is limited to off-peak traffic times if possible, which extends the duration of the project.

When maintenance is performed on the main cables, workers generally must walk on top of the main cable, using a hand rope parallel above the cable to maintain balance. For safety reasons when the workers are working on the main cable, it is generally necessary to shut down several if not all lanes on the bridge to traffic which is not only inconvenient but also has economic consequences.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a support for a work platform that permits a worker to safely traverse a main cable of a suspension bridge. Accordingly, the present disclosure provides a support for a below main cable work platform that permits a worker to traverse a main cable of a suspension bridge by walking on a flat surface platform situated below the main cable.

Another aspect of an example embodiment in the present disclosure is to provide a support for a work platform that allows bridge maintenance to be performed without disrupting traffic. Accordingly, the present disclosure provides a support for a below main cable work platform that allows bridge maintenance to be performed by workers standing on a flat platform, minimizing safety risks while working above traffic, allowing traffic to flow without disruption while maintenance work is performed.

A further aspect of an example embodiment in the present disclosure is to provide a work support that fastens to a band on the main bridge cable without disrupting the distribution of a deck load. Accordingly, the present disclosure provides a support that couples to a band on a cable by attaching a plate to the band and coupling a work platform support to the band, further coupling the work platform support to the band with a temporary strap, maintaining tension and load on the cable with the temporary strap.

Accordingly, the present disclosure describes a below main cable work platform support for hanging a work platform below a main cable of a suspension bridge and a method of installation thereof. A plurality of supports attach to a plurality of bands on a main cable. Each support has a pair of struts bolted to the band, the top of each strut on each side of the band, the struts extending downward, connecting to the ends of a horizontal bar that sits between a pair of suspender cables hanging from each band. A work platform is suspended from the horizontal bar and tie down cables extend downward from the bar attaching below to stabilize the platform against wind and uplift. The method includes the step of screwing a single bolt into a cable band for supporting a structure therebelow.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1A:
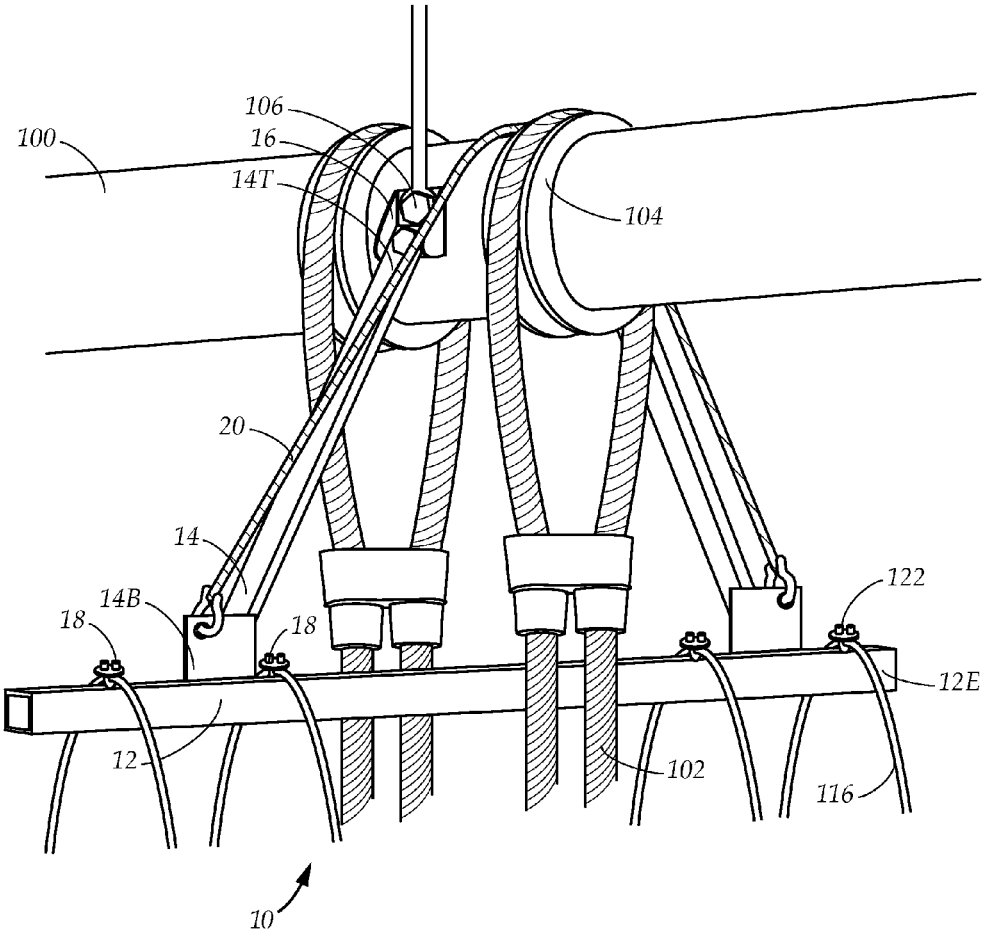
FIG. 1A is a dynamic perspective view of an example embodiment of a below main cable work platform support in place on a bridge main cable.

FIG. 1A illustrates a below main cable work platform support 10, hereafter referred to as a platform support, in place on a bridge main cable 100. The bridge main cable is one of several suspension main cables suspended between a plurality of towers. A plurality of vertical suspender cables hang off the main cables, the main cables and suspender cables bearing the load-bearing portion of the bridge called the deck. The below main cable work platform support supports a below main cable work platform when the platform is in a position for performing maintenance work on the main cable of the suspension bridge. The below main cable work platform allows maintenance work on the main cable to occur without shutting a portion of the bridge deck to traffic.

In this disclosure, a method of attaching and supporting a particular style of work platform will be discussed. However, it is understood that the method and the support can be applied to many types of platforms and scaffolding for use on a suspension bridge main cable and it not limited to the particular structure or use shown in the illustrations.

Figure 1B:
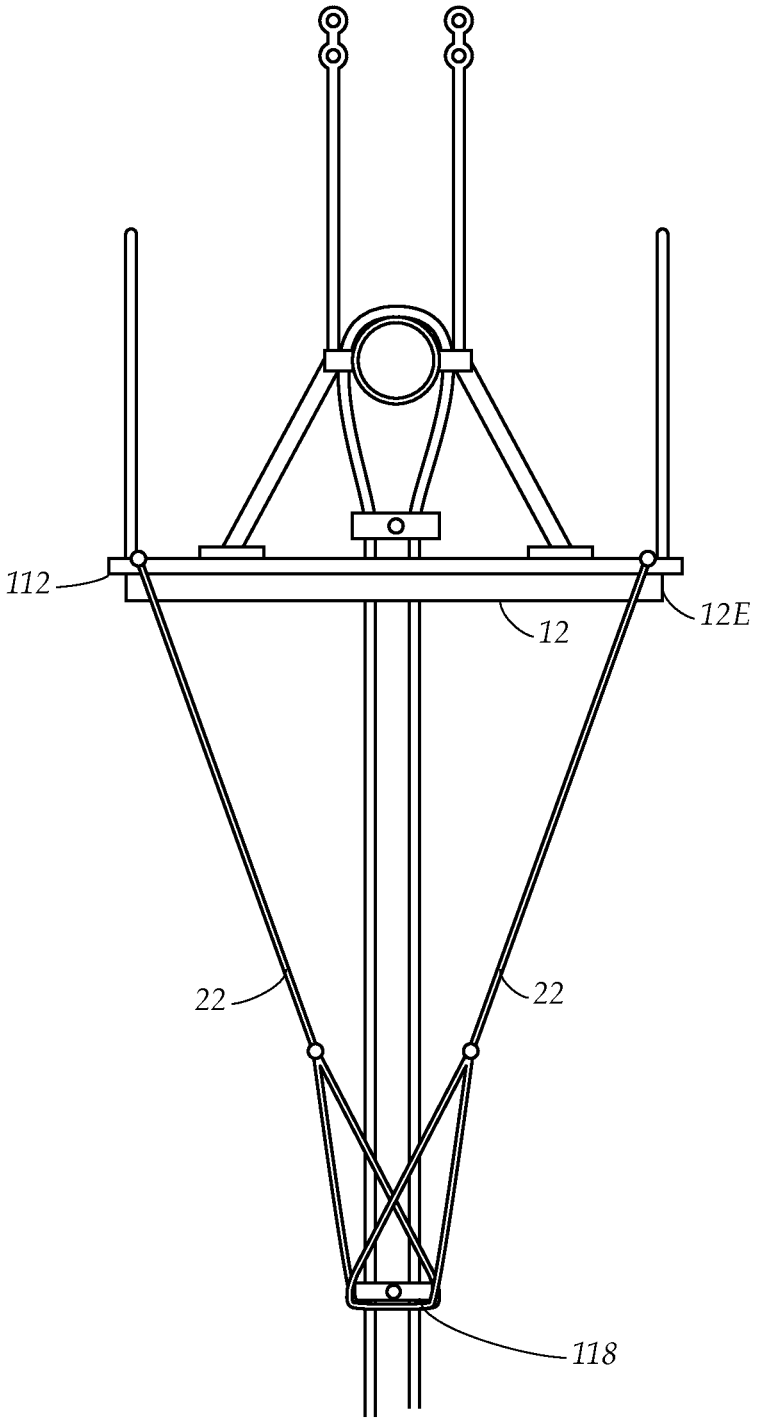
FIG. 1B is a side elevational view in cross section of an example embodiment of the below main cable work platform support in place on a bridge main cable.

The support has a pair of struts 14 and a horizontal bar 12 connecting the struts. Each strut has a top end 14T and a bottom end 14B. The horizontal bar 12 has a top and a pair of opposing end portions 12E. The bottom end 14B of each strut attaches to the horizontal bar 12 substantially towards an opposing end portion 12E of the bar, a strut coupled to each end forming an isosceles triangle with the main cable at the apex of the triangle. In one embodiment, as shown in FIG. 1B, the triangle formed by extending imaginary lines from the tops of the struts is an equilateral triangle.

The horizontal bar 12 is further stabilized by a pair of tie-downs 22, the tie downs attaching to the ends of the bar 12E and extending downward, attaching to the bridge structure below 118. The tie-downs 22 and bar 12 form a second isosceles triangle.

Referring again to FIG. 1A, the top 14T of each strut attaches to a plate 16 that fits snugly against the a band on the main cable. The band has a pair of opposing sides, one plate fastening to each opposing side of the band. The strut and plate fasten to the band by a single bolt.

The horizontal bar 12 hangs between a pair of suspender cables 102. A temporary strap 20 straddling the band and attaching to the horizontal bar is in place to stabilize the support during installation. The temporary strap temporarily distributes the decking section load without disrupting the main cable load. Disruption of the load on a suspension bridge can have catastrophic results. The temporary strap helps to prevent the disruption during the installation of the work platform supports and work platform.

In the illustration, a plurality of cord guides 18 are on the top of the horizontal bar 12 for placing a plurality of cords of the work platform prior to clamping and installing the work platform. The cord guides 18 govern a plurality of cords 116. A plurality of clamps 122 fastened to the cord guides, one clamp on each cord guide after one cord of the decking section is placed through the cord guide, the cords operative for hanging a decking section of a below main cable work platform. In one example embodiment, the clamp is a U-clamp. It is understood that substituting other types of fastening systems are possible with this support 10 operative for hanging other structures, scaffolding and platforms from the main cable.

Figure 3:
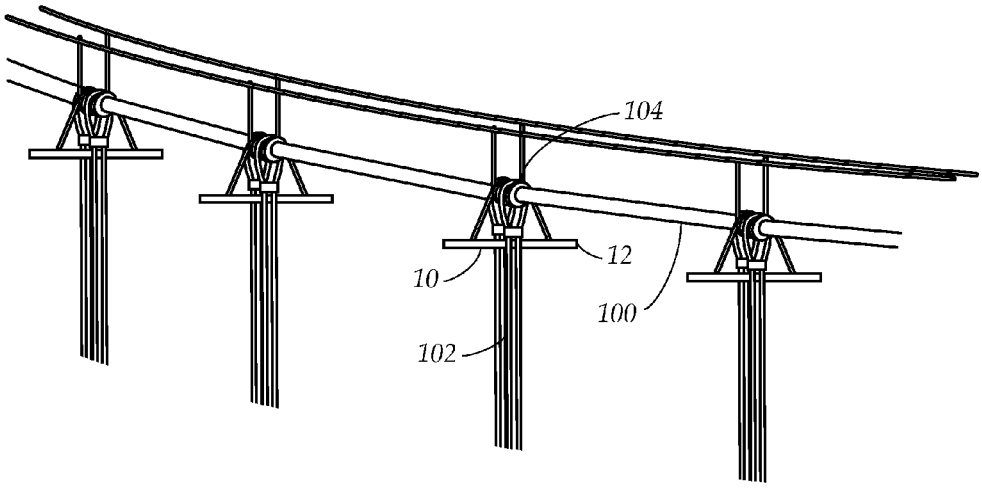
FIG. 3 is a dynamic perspective view of a plurality of the below main cable work platform supports in place on the main cable prior to installing the work platform below the cable.

As illustrated in FIG. 3, a plurality of work platform supports 10 are installed on the bands 104 before a plurality of decking sections are installed, the horizontal bar 12 between each pair of suspender cables 102.

The system for maintaining a main cable on a suspension bridge without shutting a portion of the suspension bridge to traffic is illustrated in FIG. 3. A plurality of supports 10 are fastened to a plurality of bands 104 on the main cable, each band having at least one support, the horizontal bar 12 of each support between each pair of suspender cables 102 on each band.

Each support has a pair of plates fastened to the each band as explained hereinabove as shown in FIG. 1A.

Figure 4:
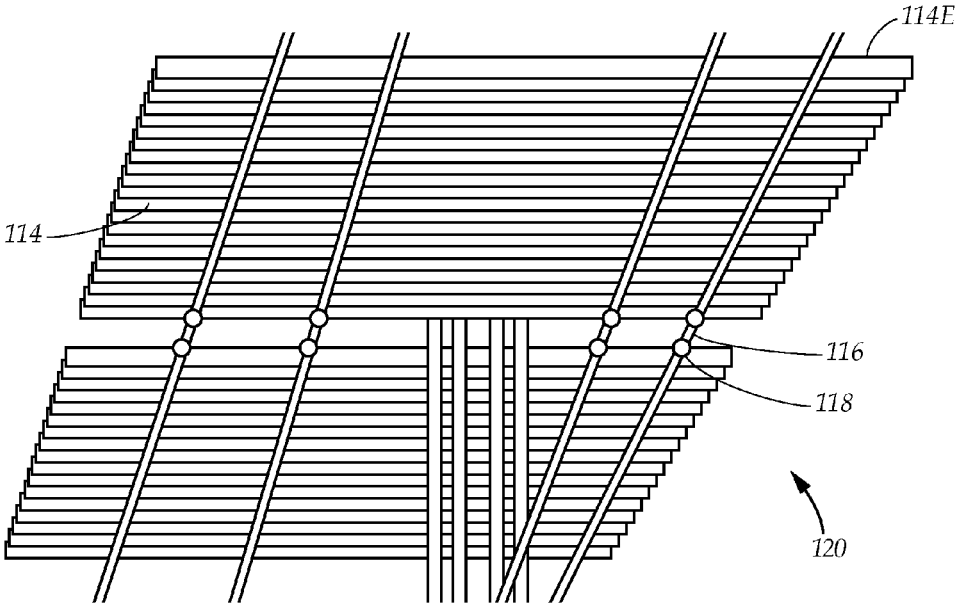
FIG. 4 is a perspective view from below of the work platform installed on the example embodiment of the below main cable work platform supports.

As shown in FIG. 4, a plurality of decking sections 114 hang from cords 116 in the cord guides of the horizontal bars, each decking section having an opposing edge 114E abutting the opposing edge of an adjacent decking section, forming a continuous platform 120 below the entirety of the main cable.

The system has clamps 122 fastened to the cord guides 18, as shown in FIG. 1A, one clamp on each cord guide after one cord 116 of the decking section is placed through the cord guide. Note the drawing shows the cords in a slack state for purposes of illustration, but generally are in a taut state resulting from the weight of the decking section.

Figure 6:
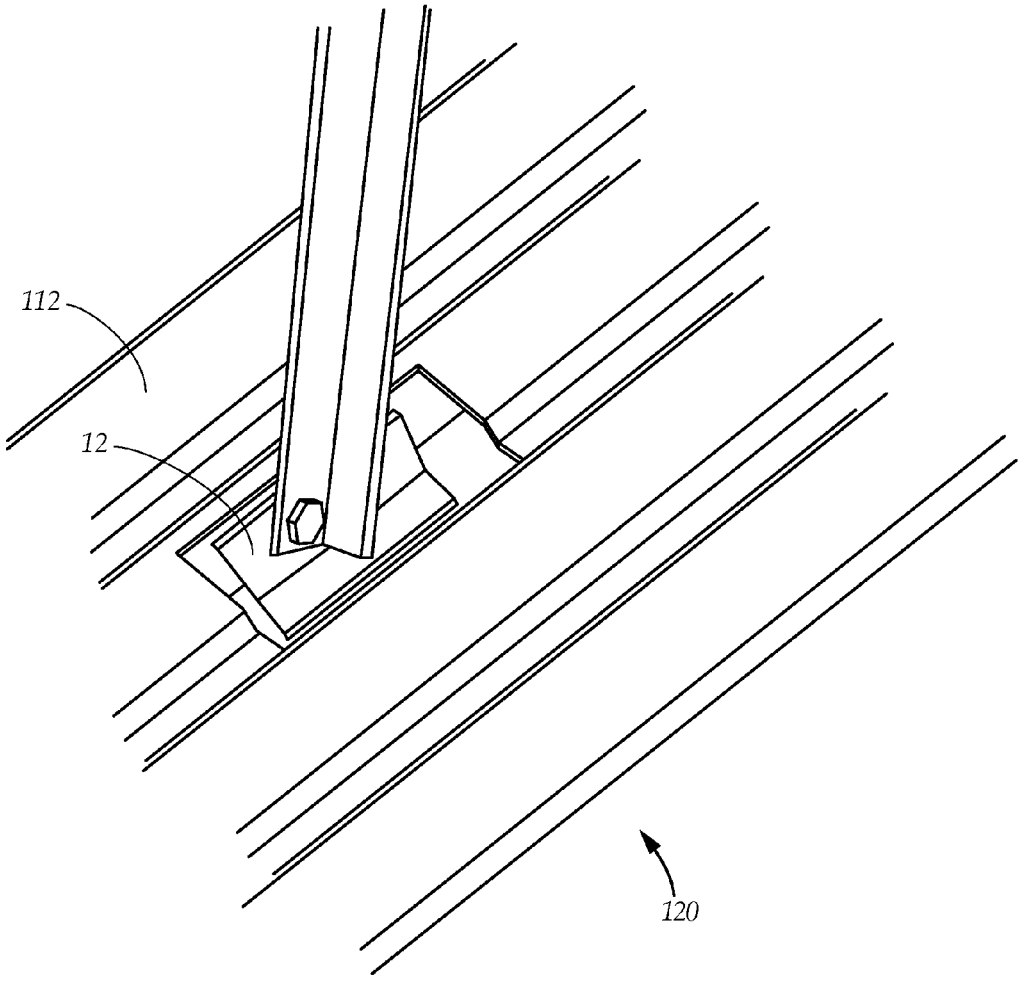
FIG. 6 is a dynamic perspective view of the platform in place on the example embodiment of the below main cable work platform support with an overlay portion connecting a pair of sections of the deck and covering a horizontal bar of the below main cable work platform support.

As shown in FIG. 6, an overlay decking portion 112 covers each horizontal bar 12, providing an uninterrupted surface on the continuous platform 120 below the main cable. The overlay decking portion also covers the cord guides and secures the clamped cords of the platform decking sections.

Figure 7A:
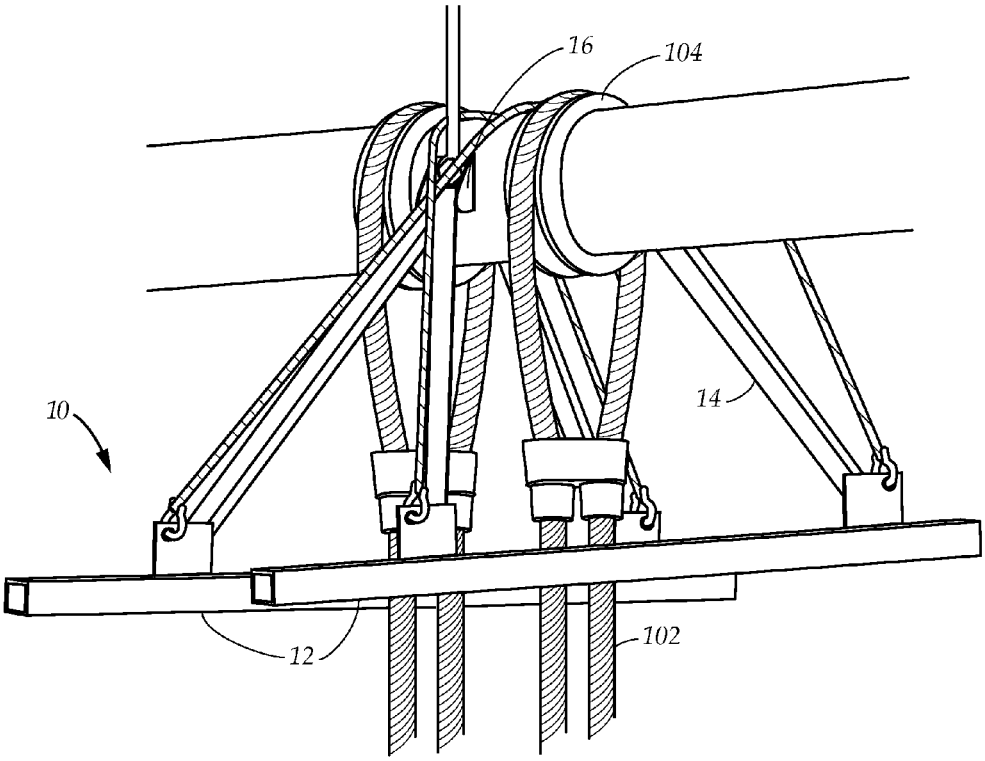
FIG. 7A is a dynamic perspective view of a further example embodiment of a below main cable work platform support in place on a bridge main cable, the support having a pair of horizontal bars.

FIG. 7A demonstrates another example embodiment of the work platform support 10. A pair of supports 10 is fastened to each band 104 through one pair of plates 16. The support has two pairs of struts 14, each coupled to one horizontal bar 12 of a pair of horizontal bars 12, the horizontal bars on the outside of the suspender cables 102.

Figure 7B:
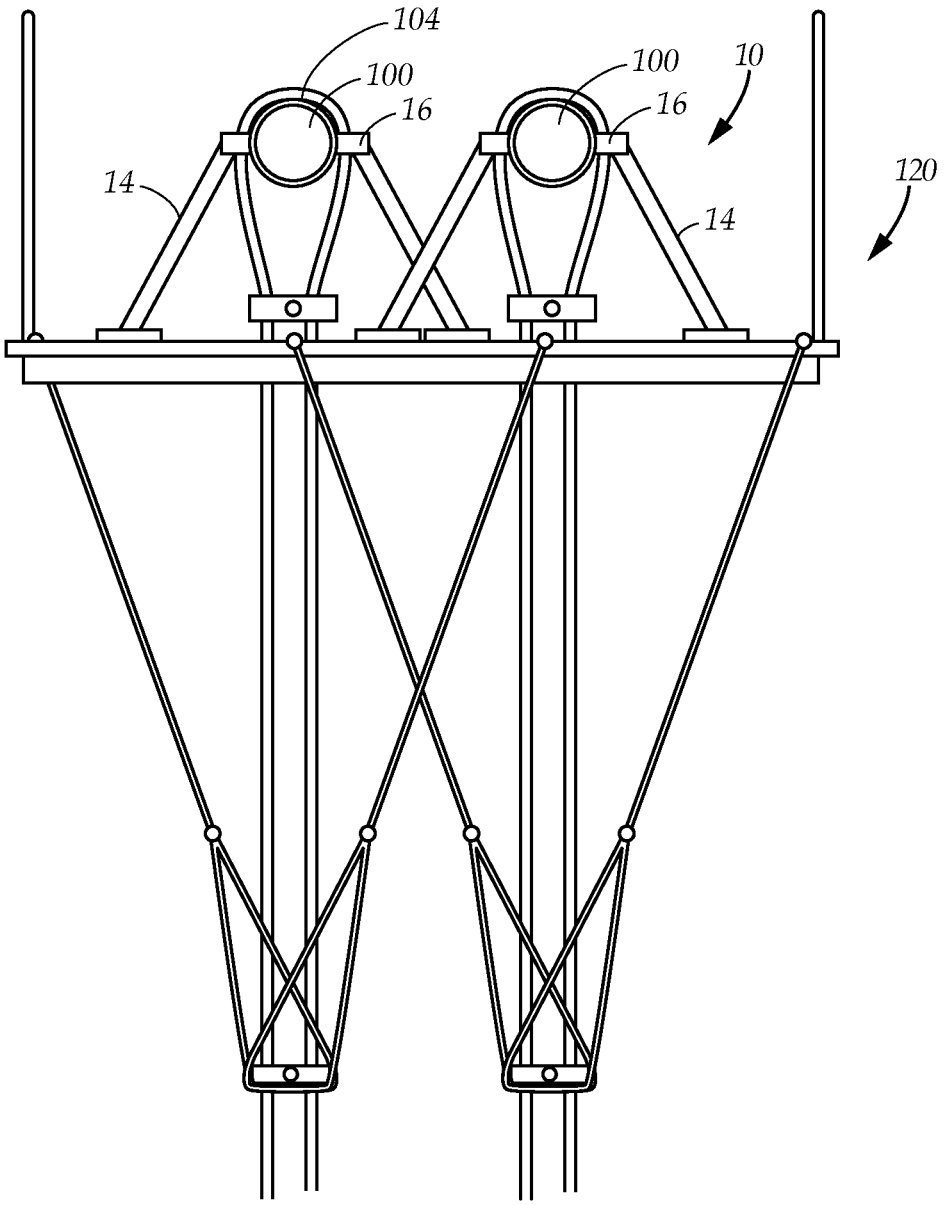
FIG. 7B is a side elevational view in cross section of another example embodiment of the below main cable work platform support in place on a pair of twin bridge main cables.

As shown in FIG. 7B, in one example embodiment, the bridge has a pair of twin main cables 100 in parallel on each side of the bridge. The below main cable work platform support 10 has the plates 16 and struts 14 coupled to bands 104 on each main cable, the struts 14 on the two cables coupled to one horizontal bar 12. The below main cable work platform 120 is supported on the work platform support 10 as described hereinabove.

Figure 5:
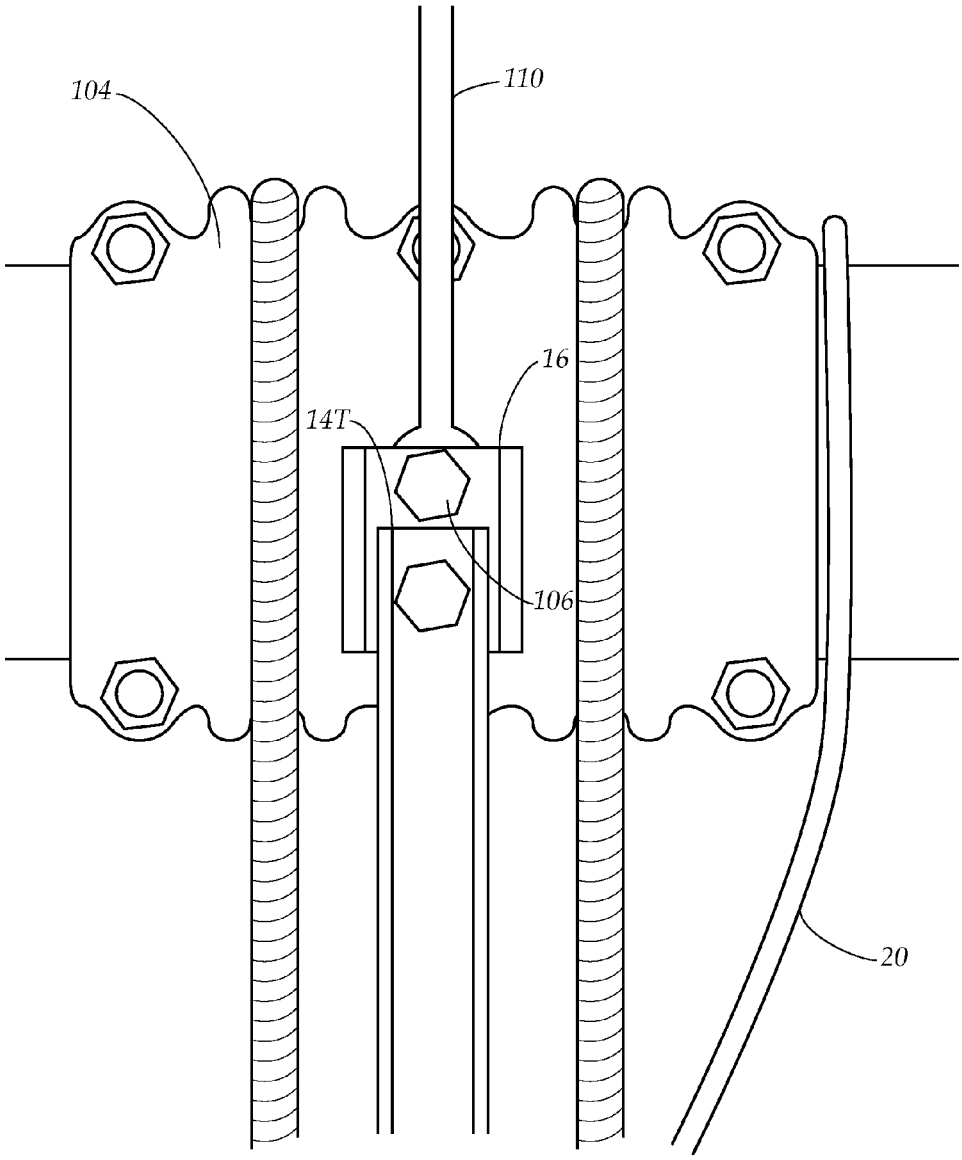
FIG. 5 is a side elevational view of a strut of the support bolted to a band on the bridge main cable.

The method of attaching the support is described in detail hereinbelow. FIG. 5 shows a novel step of the method. On each band 104 on the main cable, are a pair of side bolts 106, one on each side. Coupled to the side bolts are hand rope supports 110 that extending vertically above. Each bolt is temporarily removed and the plate 16 is coupled to the bolt 106 and hand rope support 110 when the bolt is replaced. The top of the strut 14T is coupled to the plate 16 below the bolt 106. A temporary strap 20 is placed over the band 104 to stabilize the support during installation. Balancing the load throughout the bridge structure at all times is critical and the method requires temporary stabilization until installation is complete.

Figure 2:
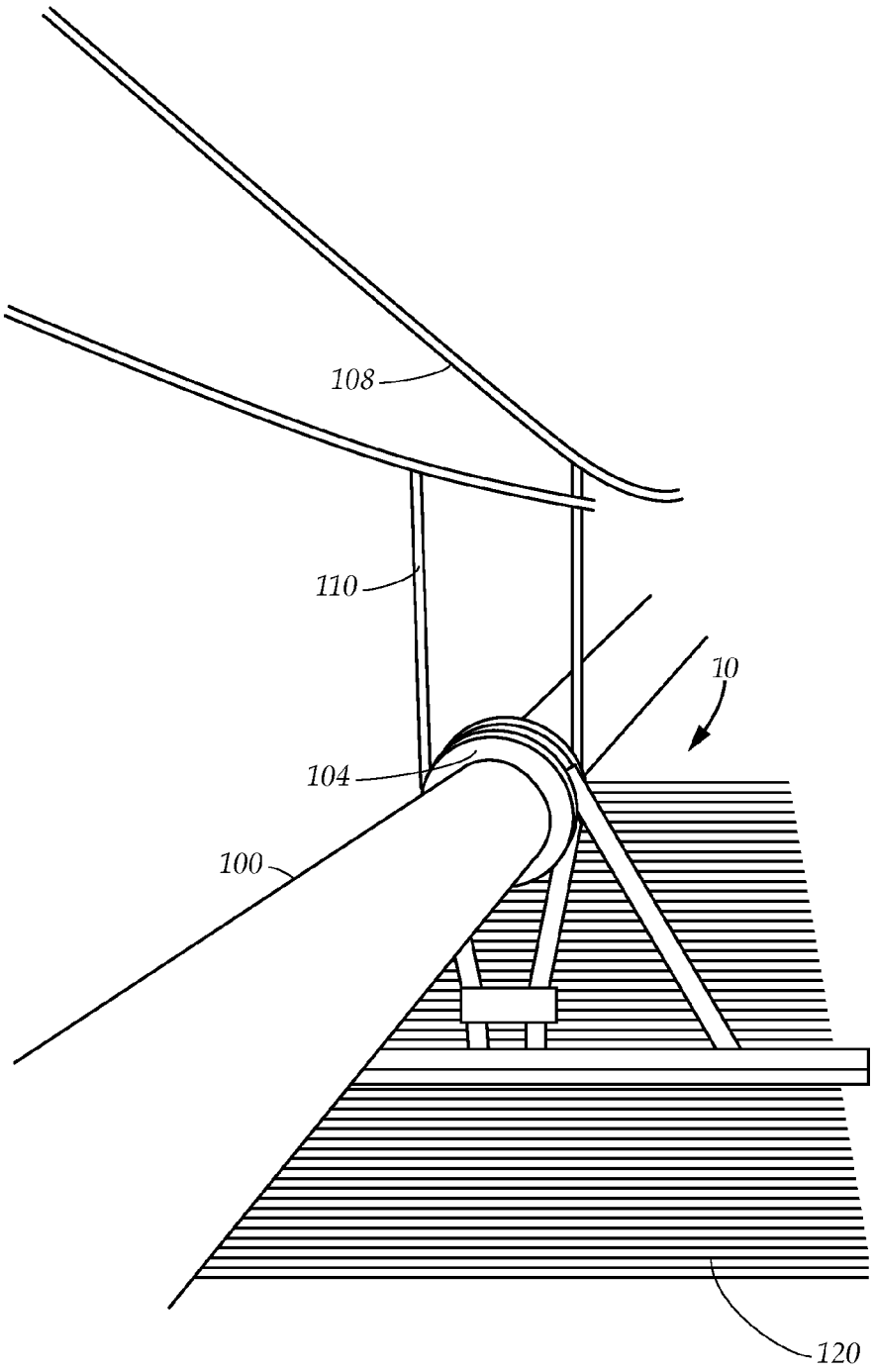
FIG. 2 is a dynamic perspective view of an example embodiment of the below main cable work platform support in place on a bridge main cable, maintaining the work platform below the cable.

FIG. 2 shows a hand rope 108 and the hand rope supports 110 extending above each band on the main cable. The hand rope and hand rope supports are pre-existing structures that are present prior to the installation of the below main cable work platform supports 10 and a below main cable work platform 120. Without the below main cable work platform, workers walk on top of the cable, using the hand rope for support. Without the below main cable work platform, cable maintenance can only be performed when traffic on the deck below is prohibited, either causing tie-ups or having the work performed on off-peak hours.

Referring to FIG. 1 A, the method of installing the below main cable work platform support 10 in place on a bridge main cable comprises removing the bolt 106 coupling the hand rope support 110 to the main cable band 104 and reattaching the bolt with the hand rope and the plate 16 as described hereinabove. The top of a first strut 14T on the support 10 is coupled to one plate 16 and the top of a second strut us coupled to one plate on an opposing side. In one embodiment, the horizontal bar 12 is coupled to the bottoms 14B of the first and second strut 14 prior to coupling the struts to the plates 16 and in another embodiment, the bar 12 is coupled to the struts 14 after the struts are in place on the plates on the band.

The support 10 is stabilized by at least one temporary strap 20. Decking portions are coupled to the fastening means on the horizontal bar. In FIG. 1A, as a non-limiting example, cord guides 18 are on the horizontal bar and cords are placed in the guides and clamped in place. Gaps in the decking are covered by overlay portions 112 as shown in FIG. 6. As shown in FIG. 1B, the horizontal bar 12 is further stabilized by a pair of tie-downs 22, the tie downs attaching to the ends of the bar 12E and extending downward, attaching to the bridge structure below 118. Once the decking section 112 and tie-downs are installed, the temporary strap can be removed.

Once the supports 10 are coupled to the each band 104 on the main cable 110, as shown in FIG. 3, the platform deck or other structures can be installed. FIG. 4 shows a plurality of decking sections 112 having a plurality of planks connected by a plurality of cords 116. In this embodiment, the cords of the deck 120 are placed in the cord guides 18 and clamped in place. As explained hereinabove, other configurations of decking and scaffolding structures with different fastening means are possible within the inventive concept.

FIG. 6 shows an overlay decking portion 112 covering the horizontal bar 12 of the support, to cover a gap for safety reasons and to protect the cords in the cord guides.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a below main cable work platform support. The disclosure is illustrated by example in the drawing figures, and throughout the written description. It should be understood that numerous variations are possible, while adhering to the inventive concept. Such variations are contemplated as being a part of the present disclosure.

What is claimed is:

1. A below main cable work platform support, for supporting a below main cable work platform, the platform in a position for performing maintenance work on the main cable of a suspension bridge, comprising:

a pair of plates, the plates fastening to a band on a main cable, the band have a pair of opposing sides, one plate fastening to each opposing sideof the band by a bolt;

a pair of struts, a strut having a top end and a bottom end, the top end of each strut fastening to each plate;

a horizontal bar, the bar having a top and a pair of opposing end portions, the bottom end of each said strut attaching substantially at the end portion of the horizontal bar, one strut on each opposing end portion of the horizontal bar, the horizontal bar hanging from the struts between a pair of suspender cables hanging from the band;

a plurality of cords guides on the top of said horizontal bar, the cord guides operative for governing a plurality of cords, the cords operative for hanging a decking section of a below main cable work platform in a position for performing maintenance work on the main cable of a suspension bridge, allowing maintenance work on the main cable to occur without shutting a portion of the bridge to traffic.

2. The below main cable work platform support as described in claim 1, further comprises a temporary strap operative for stabilizing the support during installation of the decking section, the temporary strap temporarily distributing the decking section load without disrupting the main cable load.

3. The below main cable work platform support as described in claim 2, further comprises a pair of tie downs operative for stabilizing said support, the tie downs attaching to the ends of the horizontal bar and extending downward, attaching to the bridge below the below main cable work platform.

4. The below main cable work platform support as described in claim 3, wherein a plurality of clamps fastens to the cord guides, one clamp on each cord guide after one cord of the decking section is placed through the cord guide.

5. The below main cable work platform support as described in claim 4, wherein the bridge has a pair of twin main cables and the below main cable work platform support has the plates and struts coupled to bands on each main cable, the struts on the two cables coupled to one horizontal bar.

6. The below main cable work platform support as described in claim 4, wherein the struts and the horizontal bar form an imaginary triangle, the horizontal bar forming the base of said triangle, the apex of said triangle at the cable band.

7. The below main cable work platform support as described in claim 6, wherein the triangle is an isosceles triangle.

8. The below main cable work platform support as described in claim 7, wherein the triangle is an equilateral triangle.

9. The below main cable work platform support as described in claim 8, wherein a plurality of the supports are fastened to a plurality of the bands, each band having at least one of the support, the horizontal bar of each support positioned between each pair of suspender cables on each band, a plurality of decking sections hanging from said cords in the cord guides of the horizontal bars, each decking section abutting an adjacent decking section, forming a continuous platform below the entirety of the main cable.

10. The below main cable work platform support as described in claim 9, wherein an overlay decking portion covers each horizontal bar, providing an uninterrupted surface on the continuous platform below the main cable.

11. The below main cable work platform support as described in claim 10, wherein a pair of said supports are fastened to each band, the pair of suspender cables between each support.

12. A system for maintaining a main cable on a suspension bridge without shutting a portion of the suspension bridge to traffic, comprising:

a plurality of bands on a main cable, each band having a pair of opposing sides, each band bearing a pair of vertical suspender cables;

a plurality of below main cable work platform supports having a pair of plates, the plates fastening to the band on a main cable, the band have a pair of opposing sides, one plate fastening to each opposing side of the band, said support having a pair of struts, a strut having a top end and a bottom end, the top end of each strut fastening to each plate, said support having a horizontal bar, the bar having a top and a pair of opposing end portions, the horizontal bar hanging from the struts between the pair of suspender cables, the bottom end of each strut attaching to the horizontal bar, one strut on each opposing end portion of the horizontal bar, said horizontal bar having a plurality of cords guides on the top of said horizontal bar; and a plurality of decking sections, the decking section hanging from a plurality of cords, each cord coupled to a cord guide on the horizontal bar of the supports, each decking section having a pair of opposing edges, said each decking section linearly abutting the edge of another decking section, forming a continuous below main cable work platform below the entirety of the main cable allowing maintenance work on the main cable to occur without requiring shutting a portion of the suspension bridge to traffic.

13. The system as described in claim 12, further comprises a temporary strap operative for stabilizing the support during installation of the decking section, the temporary strap temporarily distributing the decking section load without disrupting a load of the main cable.

14. The system as described in claim 13, further comprises a pair of tie downs operative for stabilizing said support, the tie downs attaching to the ends of the horizontal bar and extending downward, attaching to the bridge below the below main cable work platform.

15. The system as described in claim 14, further comprises a plurality of clamps fastening to the cord guides, one clamp on each cord guide after one cord of the decking section is placed through each cord guide.

16. The system as described in claim 15, wherein an overlay decking portion covers each horizontal bar, providing an uninterrupted surface on the continuous platform below the main cable.

17. A method of installing a below main cable work platform for performing maintenance work on a main cable of a suspension bridge without requiring shutting a portion of the suspension bridge to traffic, comprising:

installing a plurality of below main cable work platform supports, each support installed by the following steps, comprising:

(a) installing a pair of plates on a band on a main cable, one plate on each opposing side of the band, installing each plate with a bolt of the band by detaching said bolt and reattaching said bolt to said plate and said band on the main cable, thereby coupling the plate to the band on the main cable;

(b) coupling a pair of struts, one strut to each plate, the strut having a bottom end and a top end, said top end coupling to the plate;

(c) coupling a horizontal bar to the bottom end of the struts, the bar having a top with a plurality of cord guides, the bar having a pair of ends, one end coupling to the bottom end of one strut of, said struts, said horizontal bar and said plates forming the below main cable work platform support;

(d) stabilizing the below main cable work platform support by fastening a temporary strap over the band, said strap having a pair of ends, each end connecting to each end of the horizontal bar; and hanging a plurality of decking portions, the decking portions having a plurality of the decking portions hanging from the below main cable work platform support by a plurality of cords, the cords coupled to the cord guides on the horizontal bar, each decking section having a pair of opposing edges, an edge of each decking section linearly abutting the edge of another decking section, forming a continuous below main cable work platform below the entirety of the main cable allowing maintenance work on the main cable to occur without requiring shutting a portion of the suspension bridge to traffic.

18. The method as described in claim 17, wherein the step of hanging the decking sections is followed by the step of covering the horizontal bars with a plurality of overlay decking portions, one portion covering each horizontal bar.

19. The method as described in claim 17, wherein the step of hanging a plurality of decking sections is followed by the steps of stabilizing the below main cable work platform support by installing a pair of tie downs each tie down attaching to one end of the horizontal bar and attaching to the bridge; and removing the temporary straps from the bands and horizontal bars.

20. The method as described in claim 17, wherein the step of coupling the horizontal bar to the bottom end of the struts precedes the step of coupling the pair of struts to the pair of plates.

* * * * *